US008756754B2

(12) United States Patent
Allen et al.

(10) Patent No.: US 8,756,754 B2
(45) Date of Patent: Jun. 24, 2014

(54) ANTI-VIBRATION CANTILEVERED HANDLE FOR A BLOWING APPARATUS

(75) Inventors: John Allen, Texarkana, TX (US); Andrew Curtis, Texarkana, TX (US)

(73) Assignee: Husqvarna AB, Huskvarna (SE)

( * ) Notice: Subject to any disclaimer, the term of this patent is extended or adjusted under 35 U.S.C. 154(b) by 393 days.

(21) Appl. No.: 13/139,255

(22) PCT Filed: Dec. 11, 2008

(86) PCT No.: PCT/US2008/086464

§ 371 (c)(1),
(2), (4) Date: Aug. 22, 2011

(87) PCT Pub. No.: WO2010/068214

PCT Pub. Date: Jun. 17, 2010

(65) Prior Publication Data

US 2011/0289721 A1 Dec. 1, 2011

(51) Int. Cl.

| | |
|---|---|
| ***A47L 9/32*** | (2006.01) |
| ***F04D 25/00*** | (2006.01) |
| ***F04B 17/05*** | (2006.01) |

(52) U.S. Cl.

USPC ..... 15/344; 15/405; 15/410; 415/119; 416/63; 417/234

(58) Field of Classification Search

USPC ..... 15/330, 344, 405, 410; 415/119; 416/63; 417/234, 363, 364, 423.14, 417/423.2

IPC .... A47L 9/32; F04D 29/66; F01D 25/00; F04B 17/05

See application file for complete search history.

(56) References Cited

U.S. PATENT DOCUMENTS

| | | | | |
|---|---|---|---|---|
| 4,318,203 | A * | 3/1982 | Satoh et al. | 15/344 |
| 5,522,466 | A | 6/1996 | Harada et al. | |
| 6,324,728 | B1 | 12/2001 | Blankenheim | |

(Continued)

FOREIGN PATENT DOCUMENTS

| | | |
|---|---|---|
| CN | 1613614 A | 5/2005 |
| CN | 1715004 A | 1/2006 |

(Continued)

OTHER PUBLICATIONS

International Search Report, Jul. 2, 2009, pp. 1-3.

(Continued)

*Primary Examiner* — David Redding

(74) *Attorney, Agent, or Firm* — Novak Druce Connolly Bove + Quigg LLP

(57) ABSTRACT

A hand carried power tool (100) is presented which includes a vibration-producing power unit (15) interconnected with an elongate handle (20). The handle (20) has a base end (24) coupled to the power unit (15) and an opposite free end (28) configured for manual gripping. Additionally a vibration damping member (50), which permits vibration-induced movement between the base end (24) of the handle (20) and the power unit (15), interstitially located between the base end (24) of the handle (20) and the power unit (15). Furthermore, a resilient biasing member (40) is coupled between the elongate handle (20) and the power unit (15). The biasing member (40) connects to the handle (20) at a location distant from the base end (24) of the handle (20) and the biasing member (40) is configured to dampen vibration-induced relative movement between the base end (24) of the handle (20) and the power unit (15).

19 Claims, 6 Drawing Sheets

(56) References Cited

U.S. PATENT DOCUMENTS

| | | | | |
|---|---|---|---|---|
| 7,300,243 | B2 * | 11/2007 | Saitou et al. | 415/119 |
| 7,412,959 | B2 | 8/2008 | Wolf et al. | |
| 7,698,779 | B2 * | 4/2010 | Schliemann et al. | 15/405 |
| 7,762,348 | B2 | 7/2010 | Stirm et al. | |
| 2006/0067801 | A1 | 3/2006 | Van Bergen | |

FOREIGN PATENT DOCUMENTS

| | | | |
|---|---|---|---|
| CN | 1958242 | A | 5/2007 |
| DE | 102004041219 | A1 | 3/2006 |
| FR | 2872445 | A | 1/2006 |
| GB | 1170313 | A | 11/1969 |
| GB | 2171045 | A | 8/1986 |
| SU | 1006220 | A | 3/1983 |
| WO | 2007069946 | A | 6/2007 |
| WO | 2008097138 | A | 8/2008 |

OTHER PUBLICATIONS

International Preliminary Report on Patentability, Mar. 31, 2011, pp. 1-10.

English Translation of the Notification of the First Office Action for Chinese Application No. 200880132328.1, dated Jul. 1, 2013.

Chinese Office Action for Chinese Application No. 200880132328.1, dated Jul. 1, 2013.

English Translation of Search Report for Chinese Application No. 200880132328.1, dated Jun. 14, 2013.

English Abstract for Chinese Publication No. CN1958242A, published May 9, 2007.

English Abstract for Chinese Publication No. CN1613614, published May 11, 2005.

Chinese Search Report for Chinese Application No. 200880132328.1, dated Jun. 14, 2013.

* cited by examiner

ANTI-VIBRATION CANTILEVERED HANDLE FOR A BLOWING APPARATUS

FIELD OF DISCLOSURE

This disclosure relates generally to hand operated implements such as leaf blowers and the like, and more particularly to anti-vibration handles of the same.

BACKGROUND

Handheld power tools, such as leaf blowers, blower/vacuums, line trimmers, chains saws, edgers and the like are used more and more for different kinds of work. For example, leaf blowers are an effective and time saving tool for clearing/cleaning large areas such as parking lots, golf courses and private and commercial lawns. The benefit of blower-type devices is especially evident when compared to conventional equipment, such as manual and mechanical sweepers, which can be foiled by such obstacles as parked cars and sand traps. In such settings, leaf blowers prove to be an excellent cleaning/clearing tool.

While some leaf blowers are designed to be carried on the back of a user, others are designed to be hand carried. For hand carriage, handles are typically provided that are fixed at each of two ends to a motor unit. In this context, "motor unit" generally refers to the actual motor/engine and an associated frame and housing. In this configuration, substantial vibration is typically imparted detrimentally to the handle by the engine and/or the driven impeller blade and associated rotating parts. Other types of devices that subject associated handles to high levels of vibration include line trimmers, edgers, and chain saws. The vibration imparted to these handles can lead to user discomfort when vibrating in a gripping hand. Therefore, the present disclosure recognizes and provides solution(s) against these negative effects through the provision of structure that buffers the vibration of the motor/engine before being transmitted to the user handles.

BRIEF DESCRIPTION OF THE DRAWINGS

Embodiments of the present application will now be described, by way of example only, with reference to the accompanying drawings, wherein.

DETAILED DESCRIPTION

Figure 1:
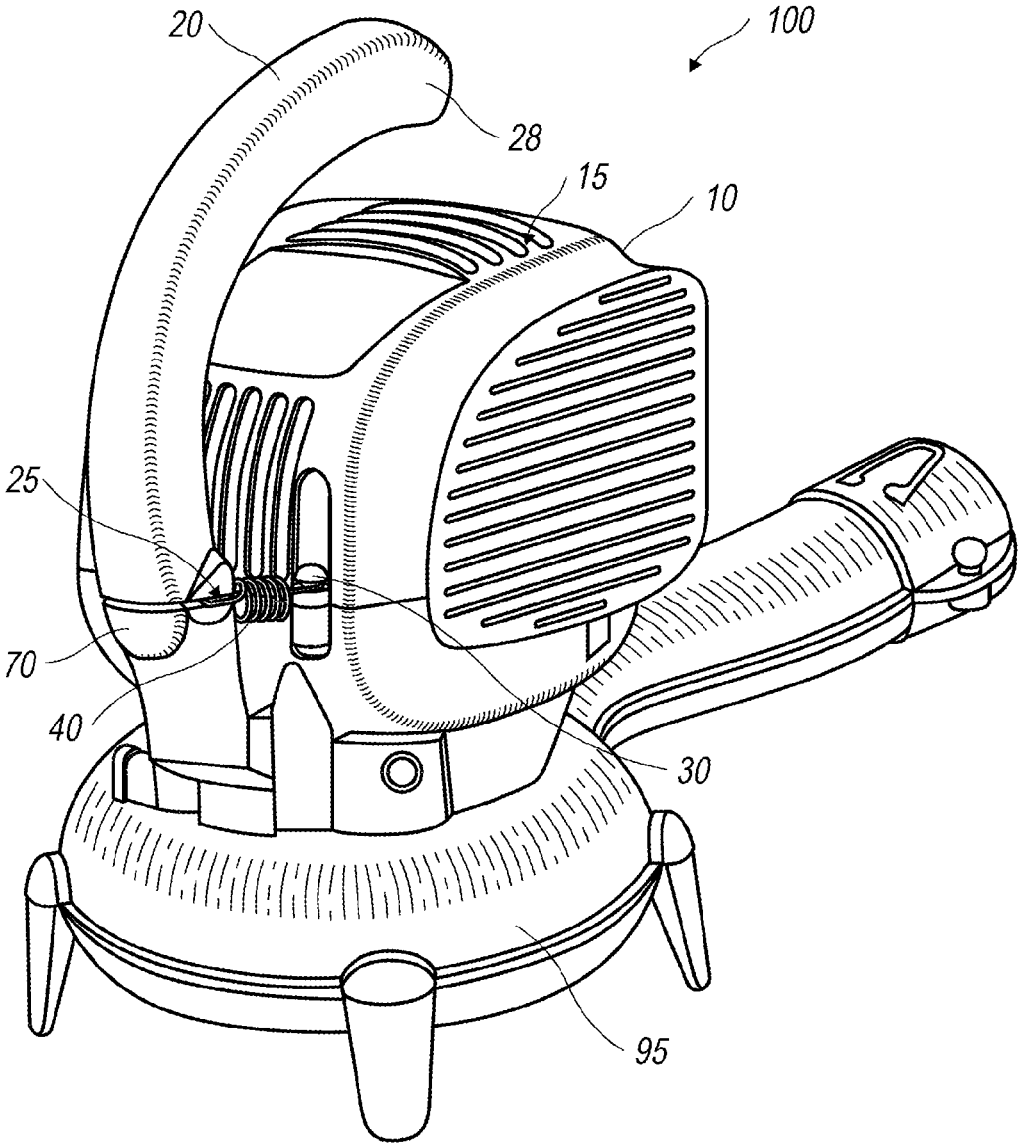
FIG. 1 is a rear perspective view of a hand carried power tool.

Example embodiments that incorporate one or more aspects of the present disclosure are described and illustrated in the drawings. These illustrated examples are not intended to be a limitation on the present disclosure. For example, one or more aspects of the present disclosure can be utilized in other embodiments and even other types of devices. Moreover, certain terminology is used herein for convenience only and is not to be taken as a limitation on the disclosed subject matter. Still further, in the drawings and description, like reference numerals are used to designate like, or substantially like, elements.

As described above, one aspect of the present disclosure relates to reducing vibration felt by a user of a hand carried power tool such as a leaf blower, edger, line trimmer, chain saw, and the like. When one of the above described devices is used, the power unit, such as an internal combustion engine, electric motor or the like normally generates vibrations imparted to the user through the handle grips, and this can detrimentally lead to user fatigue and discomfort.

An example of a hand carried power tool 100 is illustrated in FIG. 1. As illustrated, the hand carried power tool 100 is a leaf blower. While a leaf blower is illustrated, other embodiments can include line trimmers, chainsaws, edgers, vacuums, blower/vacuum combinations and other similar hand carried power tools. The hand carried power tool 100, according the present disclosure, has an elongate handle 20. As illustrated, the handle 20 is of a cantilevered type with a base end portion 24 coupled to the power unit 15 (shown under the power unit or housing 10) and a free end portion 28 extending therefrom. As illustrated, the housing 10 can comprise one or more pieces. The handle 20 can be coupled directly to the power unit 15 or it may be coupled to the power unit 15 indirectly by being connected first to housing 10 which is in turn connected to the power unit 15. Additional components or parts may also be installed between power unit 15 and the handle 20 as one of ordinary skill in the art will appreciate in light of this disclosure. As will be described further below, one of these additional components can be a vibration damping member (not shown in FIG. 1). The handle 20 is connected to the housing 10 at a receiving portion 70 on the housing 10. In this arrangement, the free end portion 28 of the handle 20 is configured for manual gripping by an operator holding the hand carried power tool 100. It should be appreciated that that the free end portion 28 gripped by the operator is not necessarily the absolute end of the handle 20, but is toward the free end compared to the base end portion 24.

Additionally, a resilient biasing member 40 coupled between the elongated handle 20 and the power unit 15 is illustrated in FIG. 1. While only one resilient biasing member 40 is illustrated more than one resilient biasing member can be implemented according to this disclosure, and as will be more fully described below. As shown, the resilient biasing member 40 is connected to the handle 20 at a location 25 distant from the base end portion 24. In this configuration, the base end portion 24 acts as a male insertion portion 65 of a stab-connection of the handle 20 to the power unit assembly in a receiving portion 70 thereupon as depicted best in FIG. 5B. As illustrated in at least FIG. 1, the resilient biasing member 40 can be connected at the housing 10 using a connector 30. While the resilient biasing member 40 is shown being connected to the housing 10, in other embodiments the resilient biasing member 40 can be connected to the power unit 15 directly. Additionally, the power unit 15 can be connected to a scroll housing 95, when the hand carried power tool 100 is a leaf blower. Other types of implements can be attached to the power unit 15 when the hand carried power tool 100 is another type of device.

Figure 2:
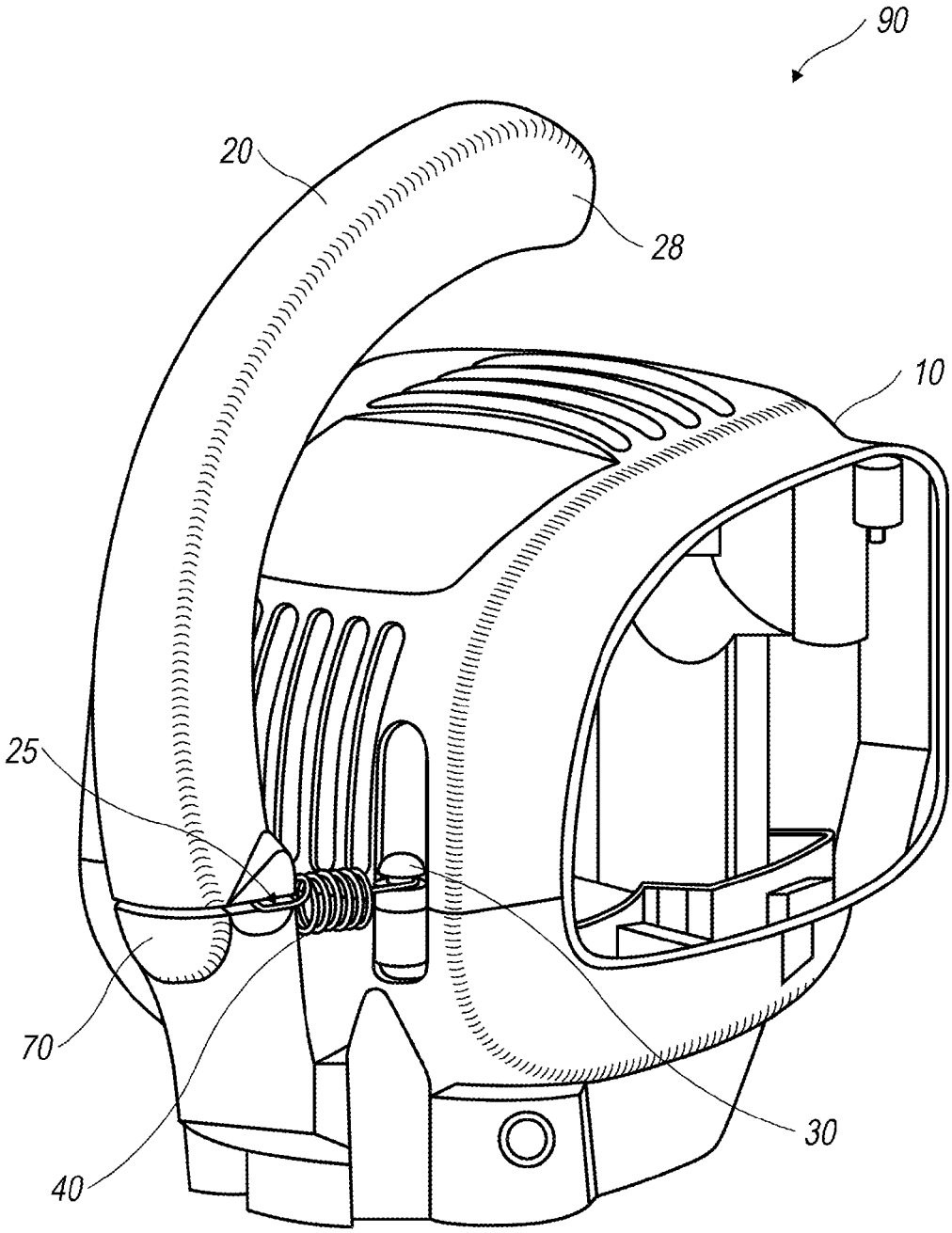
FIG. 2 is a perspective view of an exemplary housing and a cantilevered elongate handle configured according to the present disclosure.

In the illustrated embodiment of FIG. 2, the housing assembly 90 for the power unit 15 is shown in greater detail.

The housing assembly 90 includes the handle 20 and housing 10, which are illustrated here, in greater detail. As illustrated, the base end portion 24 of the handle 20 inserts inside a receiving portion 70 on the housing 10. The receiving portion 70 can be molded with the housing 10 or it can be separately made and later attached to the power unit 15 or housing 10. The resilient biasing member 40 is illustrated extending between the cantilevered handle 20 and the housing 10. The resilient biasing member 40 is shown connected to the housing 10 via a housing connector 30. The housing connector 30 can be a machine screw, bolt, screw, pin, or other mechanism for attaching the shock absorbing resilient biasing member 40 to the housing 10. The housing connector 30 can be configured to be rigidly connected. In other embodiments, the housing connector 30 can be configured to allow the resilient biasing member 40 to be slidingly connected with the housing 10. While the above example has focused on connecting the resilient biasing member 40 with the housing 10, the resilient biasing member 40, in some embodiments, can be connected to the power unit 15. Furthermore, additional connectors can be inserted between the resilient biasing member 40 and the power unit 15.

Figure 3:
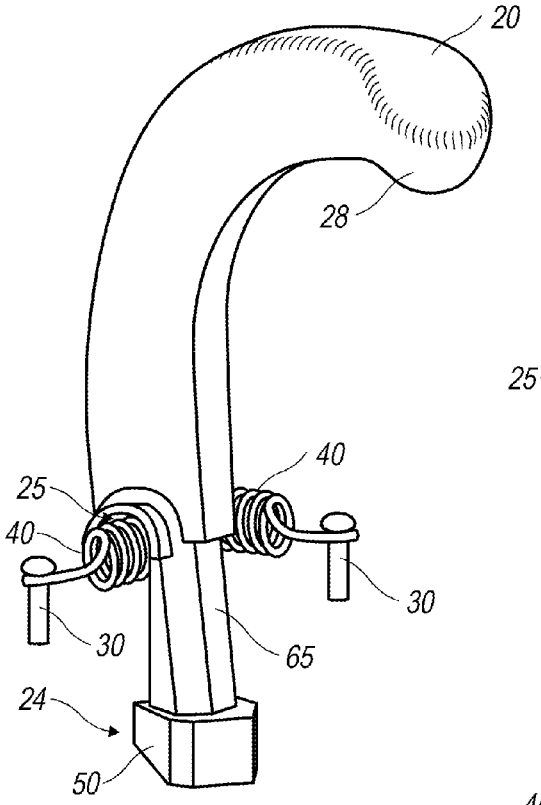
FIG. 3 is front perspective view of an exemplary elongate handle configured according to present disclosure.

A perspective view of the elongate handle 20 is shown in FIG. 3. As depicted in FIG. 3, both first and second resilient biasing members 40 are attached to the elongate handle 20. While only a pair of resilient biasing members 40 is illustrated in FIG. 3, other embodiments can include three or more resilient biasing members 40. As shown, both resilient biasing members 40 are connected to the handle at a location 25 distant from the base end portion 24 of the handle 20. The base end portion 24 of the elongate handle 20 preferably includes a vibration damping member 50. The vibration damping member 50 can be made of an elastomeric material. For example, the vibration damping member 50 can be constructed from rubber. In at least one embodiment, the vibration damping member 50 is a nitrile rubber compound. In some embodiments, the selection of the elastomeric material is made based on the durometer of the material. In at least one embodiment, the durometer of the elastomeric material is about fifty. In suitable embodiments, the elastomeric material can have a durometer between about forty and seventy-five.

As illustrated, the vibration damping member 50 has a circumference which is larger than the circumference of a male insertion portion 65 of the handle 20 that is designed to fit within a female receiving portion 70 on the power unit assembly 90. In at least one embodiment, the vibration damping member 50 takes the form of an elastomeric collar as illustrated. In this configuration, the collar 50 is gasket-like in that it spans a clearance space between the base end portion 24 of the handle 20 and the receiver provided therefore on the power unit assembly. In this way, the resilient collar 50 permits movement between the base end portion 24 and receiver, but it also resists such movement due to its elastomeric quality. In this configuration, the vibration damping member 50 acts to at least partially isolate the vibration of the power unit assembly from the handle 20.

Figure 4:
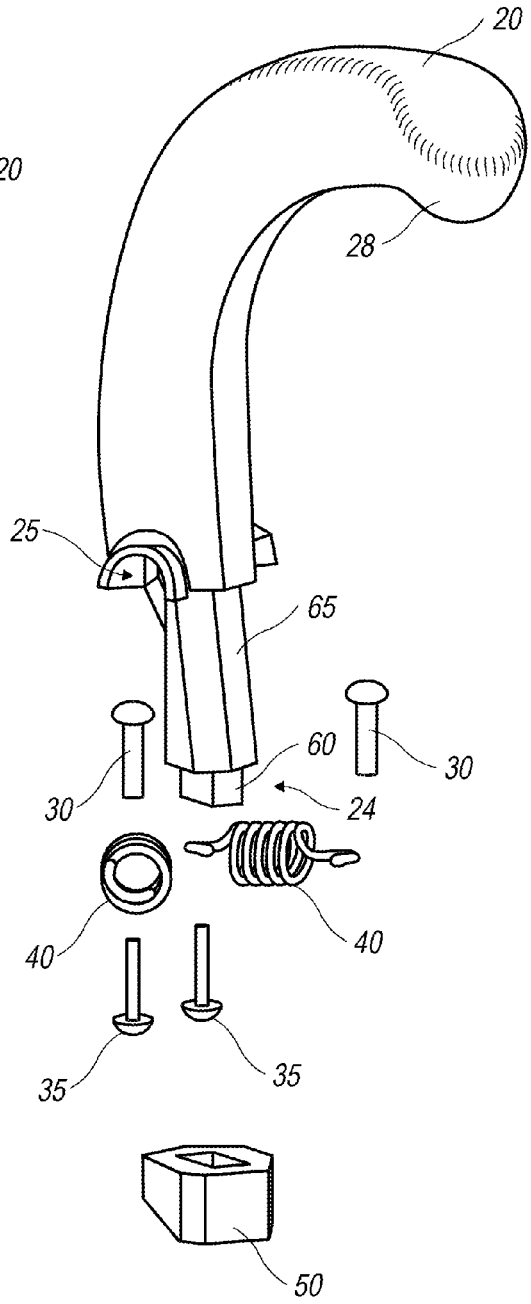
FIG. 4 is an assembly view of the exemplary elongate handle of FIG. 3.

FIG. 4 is an assembly view of the handle illustrated in FIG. 3. As depicted here, each of the pair of resilient biasing members 40 is connected to the handle 40 at the location 25 with a pair of handle connectors 35. As illustrated, each of the pair of handle connectors 35 are machine screws that fasten to the handle 20. The resilient biasing members 40 are illustrated as coil springs. The coils springs 40 have a hook on the end that is connected to the handle connectors 35. This facilitates each coil spring's sliding connection to the handle 20. This arrangement is described as an example, but other examples will be apparent to those of skill in the art in light of this disclosure for achieving such a sliding, relative connection between the springs 40 and the handle 20. When the coil springs or other resilient biasing members 40 are configured for sliding connection to the handle 20, to the engine assembly, or to both, the members' 40 variable orientation therebetween is facilitated for adjusting "tightness" and direction of applied force, both of which are purposed to reduce vibration induced in the handle 20 from the power unit assembly. However, it is also contemplated that the resilient biasing members 40 can be fixedly connected to the handle 20, as well.

The coil springs 40, as illustrated in at least FIG. 4, can be configured to reduce vibration transmitted from different engines. For instance, the number of coils can be adjusted in light of the degree of vibration induced by the particular power unit (engine, motor etc.) As illustrated, the coils of each spring 40 number approximately five. In other embodiments, the number of coils can be approximately three to twenty. The length of the coil spring 40 can also be variably selected for desired performance qualities and installations. As shown, the length of the coil spring 40 can be approximately twenty to sixty millimeters. In other embodiments the length of the coil spring 40 can be approximately forty-five millimeters. The diameter of the wire used to construct the coil spring can be approximately one-half millimeter to approximately five millimeters.

As shown in FIG. 4, the vibration damping member 50 fits over a vibration damping member receiving portion 60 of the base end portion 24 of the handle 20. The vibration damping member 50 can be removably or fixably engaged with the vibration damping member receiving portion 60 of the handle 20. The vibration damping member receiving portion 60 can have a specially designed shape to hold the damping member 50 in place. This shape can also assist in the assembly process by insuring that the vibration damping member 50 is properly installed on the vibration damping receiving portion 60. This configuration can be important if the receiving portion of the housing has a predetermined shape.

Figure 5A:
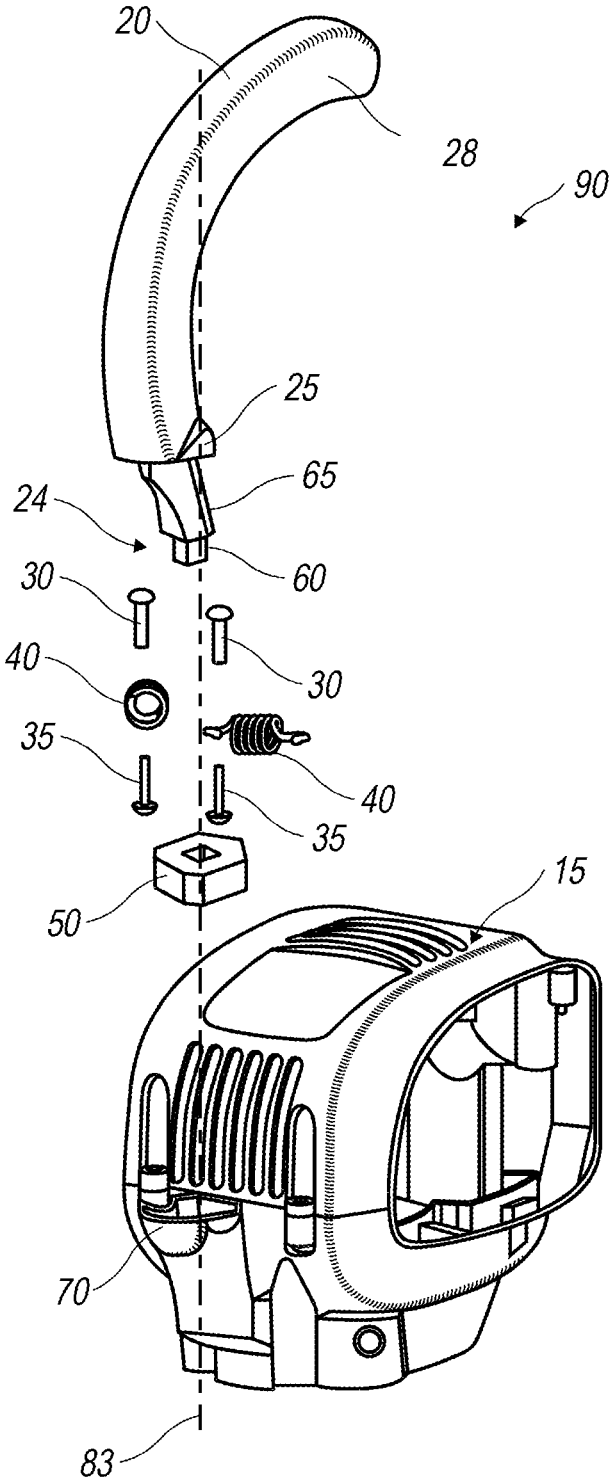
FIG. 5A is an assembly view showing installation of the exemplary handle of FIG. 3 onto the housing.

The assembly of the handle 20 to the housing 10 can be further understood with reference to FIG. 5A. As indicated above, the illustrated embodiment depicts installation of the handle 20 on the housing 10, but in other embodiments, the handle 20 can be interconnected to power unit 15 via other components that are in turn connected with the power unit 15. That is to say, and as illustrated, the vibration damping member 50 is interstitially located between the base end portion 24 of the handle 20 and the power unit 15. The vibration damping member 40 is configured to permit vibration-induced relative movement between the base end portion 24 of the handle 20 and the power unit 15. As shown, the vibration damping member 50 is of an elastomeric material which conforms to the receiving portion 70 of the housing 10, and which can be configured as described above in relation to FIG. 1.

Figure 5B:
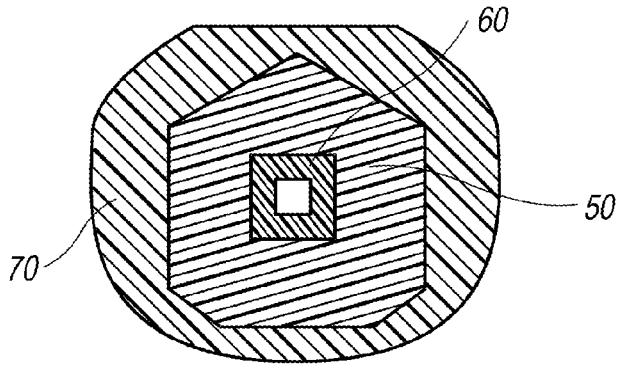
FIG. 5B is an cross-section view of the receiving portion, vibration damping member, male insertion portion, and vibration damping member receiving portion of the handle of FIG. 3.

As illustrated in at least FIGS. 3-5, the vibration damping member 50 takes the form or a ring-shaped collar having an interior shape and size and an exterior shape and size. A detailed illustration is provided in FIG. 5B, the interior and exterior shapes of the collar 50 are similar, but the exterior perimeter of the collar is larger than the defined open interior of the collar due to the widths of the collar. Preferably, the collar 50 is sized to fit snuggly about the base end portion 24 (male insertion portion 65) of the handle 20 and completely fill the clearance space between the base end portion 24 and the receiving portion 70 in the installed configuration. Still further, the exterior of the collar 50 will preferably be slightly larger than the interior of the receiving portion 70 so that a squeeze-fit of the elastomeric collar 50 is achieved between base end portion 24 of the handle 20 and the receiving portion 70. As described above, this permits, but also resists the handle 20 moving relative the power unit assembly. In this way, the use of the buffering collar 50 between the handle 20 and power unit assembly minimizes the amount of vibration that is transmitted from the power unit assembly to the handle where it would otherwise be detrimentally experienced by an operator of the power tool.

At least one resilient biasing member 40 is coupled between the elongate handle 20 and the power unit 15, as shown in FIGS. 3-5. In at least one embodiment, the resilient biasing member 40 can be an elongate tension member that exerts a tension force on the handle 20. In one example, and as described above, the elongate tension member is a coil spring. The elongate tension member 40 provides tension between the power unit 15 and the handle 20. This tension member 40 can work in conjunction with the above-described vibration reducing member 50 to reduce vibration experienced by the operator. In addition to the configuration of the tension member 40 as described above regarding the coil spring dimensions, the location of the attachment point for the tension member 40 can also change the vibration reducing characteristics of the established assembly.

As shown, this biasing member 40 is connected to the handle 20 at a location 25 that is distant from the base end portion 24 of the handle. The location 25 of the connection of the biasing member 40 can be between approximately twenty to one hundred millimeters. The location 25 can be adjusted in dependence upon the vibrational frequency generated by the power unit 15. In another embodiment, the location can be between forty and sixty millimeters. As shown, the location 25 is the same for both of the resilient biasing members 40. In other embodiments, the location 25 can differ for each of the resilient biasing members 40. This can be described such that a resilient biasing member 40 has a connection with the handle 20 at a first location and an additional resilient biasing member 40 has a connection with handle at a second location distant from the base end portion 24 of the handle 20. The first and second location can be the same distance from the base end portion 24 of the handle 20.

Figure 6:
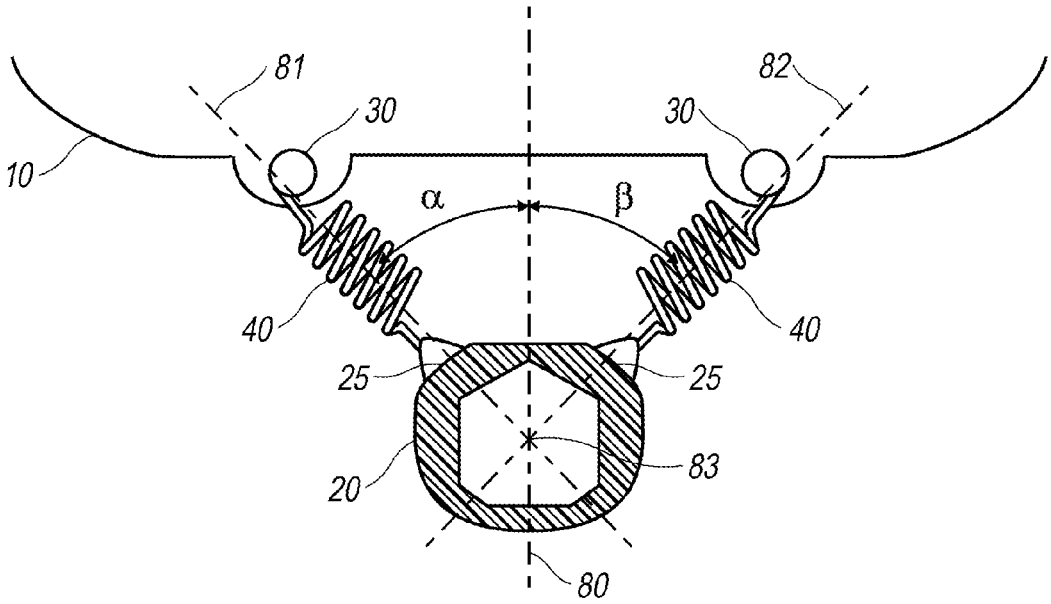
FIG. 6 is a cross-section view of the handle of FIG. 3 including resilient biasing members and their respective connections to the housing and handle.

Additionally, the resilient biasing member 40 can be arranged such that a horizontal component of a longitudinal axis 82 of the resilient biasing member 40 forms an acute angle ($\beta$) with a shortest line 80 extending horizontally between an approximate longitudinal axis (83 running into the page of FIG. 5B) of the base end portion 24 of the handle 20 and the power unit 15 when the handle 20 is in an essentially upright orientation as best illustrated in FIGS. 1 and 6. The acute angle $\beta$ can be between about thirty degrees and about sixty degrees. In the illustrated example, the acute angle $\beta$ is about forty-five degrees. The term longitudinal axis 83 of the base end portion 24 of the handle 20 is used herein for a reference to describe a general location. The longitudinal axis 83 of the base end portion 24 of the handle 20 is also illustrated in FIG. 5A. As shown in FIG. 5A, the position of the longitudinal axis is slightly shifted as compared to that of FIG. 5B. The longitudinal axis 83 is approximate because the handle is not a straight vertical handle, but instead has a curvilinear shape. With this curvilinear shape, defining a single longitudinal axis 83 is not exact and can change depending on what cross section is examined even for the base end portion 24 of the handle 20.

The resilient biasing member 40 is slidingly attached to the handle 40 at the right-hand side thereof at location 25. The resilient biasing member 40 is also connected with the housing 10 by engine connector 30, which as described above can be arranged to allow for a sliding engagement. In the illustrated example, another resilient biasing member 40 is present on the left hand side. The second resilient biasing member 40 is coupled between the elongate handle 20 and the housing 10, which in turn is connected to the engine (not shown for clarity). A horizontal component of a longitudinal axis 81 of the second (another) resilient biasing member 40 forms a second acute angle ($\alpha$) with the shortest line 80 extending horizontally between the longitudinal axis (83) of the base portion 24 of the handle 20. The acute angle $\alpha$ can be between about thirty degrees and about sixty degrees. In the illustrated example, the acute angle $\alpha$ is about forty-five degrees. As illustrated the first acute angle is approximately the same as the second acute angle. In other examples, the first acute angle can have a different measurement as compared to the second acute angle. The arrangement of the angles can be dependent upon the positioning of the engine within the housing 10. Furthermore, as described previously, the location of the resilient biasing member 40 and the second (another) resilient biasing member 40 coupling with the handle 20 can be different from one another. Likewise, other configurations as described above can be made to this arrangement.

Figure 7:
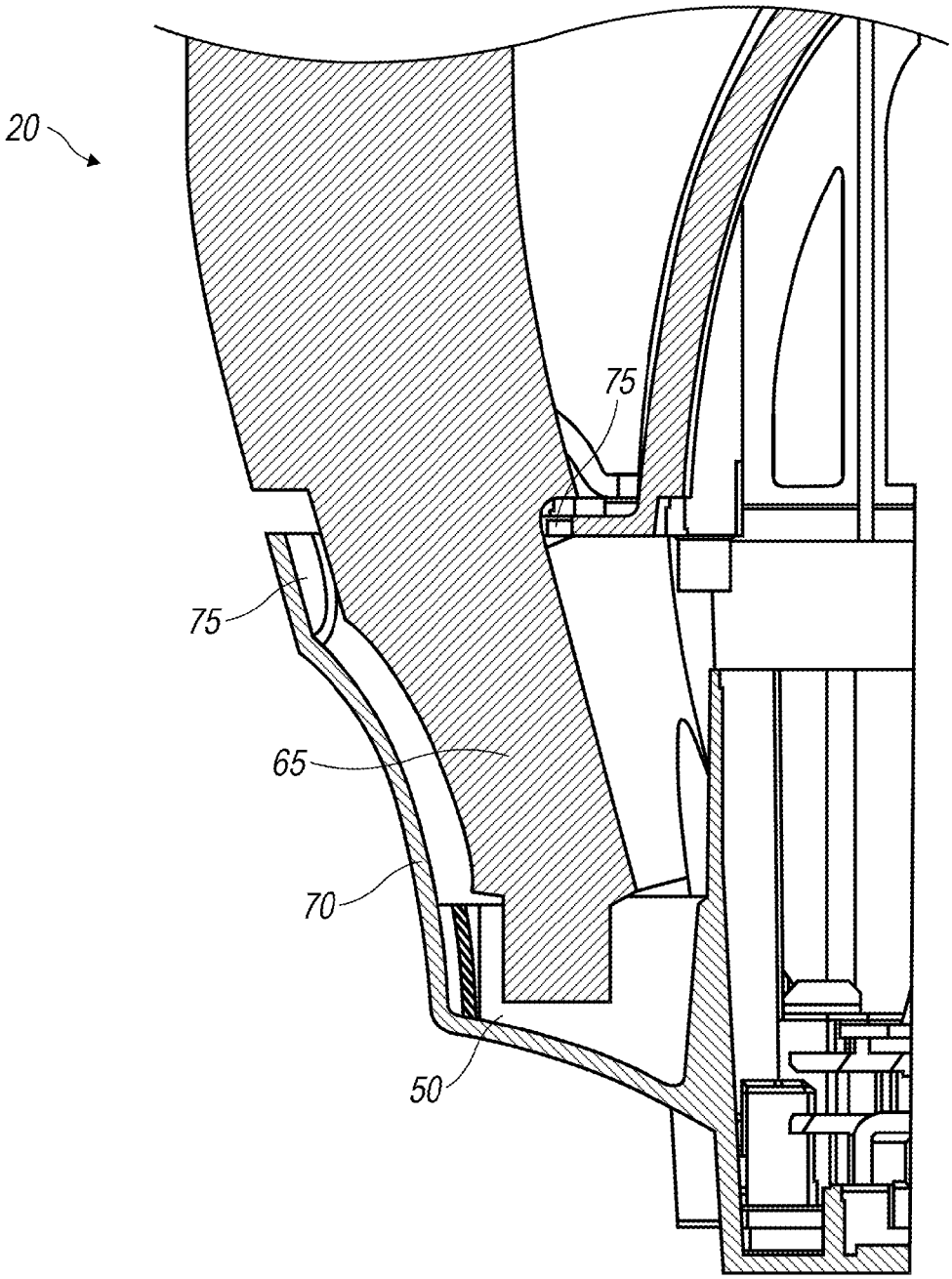
FIG. 7 illustrates an interior view of an alternative embodiment of the receiving portion 70 for the handle 20.

FIG. 7 illustrates an interior view of an alternative embodiment of the receiving portion 70 for the handle 20 that includes features, such as limiting walls that restrict movement of the handle 20 therein. As illustrated, the male insertion portion 65 of the handle 20 is received into the female receiving portion 70. At the base end of the male insertion portion 65, there is a vibration damping member 50. The vibration damping member 50 can take the form of a ring-shaped collar. The outer dimension of the damping member 50 can have a greater diameter than the diameter of the male insertion portion 65 such that there is a free space therebetween when assembled. This space facilitates the relative movement of the handle 20. As illustrated in FIG. 7, the receiving portion 70 for the handle 20 also includes limiting walls 75 to limit the allowed movement and bending of the handle 20. When the handle 20 is assembled to a power tool, the limiting walls or features 75 relieve stress on and prevent fatigue of resilient biasing members 40 that can be attached to handle 20 as the power tool is used.

While described generally herein with reference to a hand carried power tool in the form of a blower, it is to be appreciated that various other types of hand carried power tools can also be used. The hand carried power tool has been described with reference to the example embodiments described above. Modifications and alterations will occur to others upon a reading and understanding of this specification. Example embodiments incorporating one or more aspects of the disclosure are intended to include all such modifications and alterations.

What is claimed is:

1. A hand carried power tool comprising:

a vibration-producing power unit interconnected with an elongate handle, said handle having a base end portion coupled to said power unit and an opposite free end portion configured for manual gripping by an operator holding the power tool;

a vibration damping member interstitially located between the base end portion of the handle and the power unit, said vibration damping member configured to permit vibration-induced relative movement between the base end portion of the handle and the power unit;

a resilient biasing member coupled between the elongate handle and the power unit, said biasing member connected to the handle at a location distant from the base end portion of the handle and said biasing member configured to dampen vibration-induced relative movement between the base end portion of the handle and the power unit; and wherein said vibration damping member is an elastomeric material.

2. The hand carried power tool as recited in claim 1, wherein said resilient biasing member is an elongate tension member exerting a tension force on the handle.

3. The hand carried power tool as recited in claim 2, wherein a horizontal component of a longitudinal axis of said resilient biasing member forms an acute angle with a shortest line extending horizontally between a longitudinal axis of the base end of the handle and the power unit when the handle is in an essentially upright orientation.

4. The hand carried power tool as recited in claim 3, wherein said acute angle measures between approximately thirty degrees and approximately sixty degrees.

5. The hand carried power tool as recited in claim 3, wherein said acute angle measures approximately forty- five degrees.

6. The hand carried power tool as recited in claim 3, further comprising a sliding coupling between the resilient biasing member and the handle thereby facilitating variable orientation of the resilient biasing member relative to the handle.

7. The hand carried power tool as recited in claim 2, further comprising a sliding coupling between the resilient biasing member and the power unit thereby facilitating variable orientation of the resilient biasing member relative to the power unit.

8. The hand carried power tool as recited in claim 2, wherein said elongate tension member is a coil spring.

9. The hand carried power tool as recited in claim 1, further comprising an additional resilient biasing member coupled between the elongate handle and the power unit.

10. The hand carried power tool as recited in claim 9, wherein said additional resilient biasing member is connected to the handle at a second location distant from the base end portion of the handle approximately the same distance as the location from the base end portion of the handle.

11. The hand carried power tool as recited in claim 9, wherein a horizontal component of a longitudinal axis of said resilient biasing member forms a first acute angle with a shortest line extending horizontally between a longitudinal axis of the base end portion of the handle and the power unit when the handle is in an essentially upright orientation, and a horizontal component of a longitudinal axis of said another resilient biasing member forms a second acute angle with said shortest line.

12. The hand carried power tool as recited in claim 11, wherein said first acute angle and said second acute angle are approximately equal.

13. The hand carried power tool as recited in claim 11, wherein said first acute angle is different from said second acute angle.

14. The hand carried power tool as recited in claim 13, wherein said first acute angle is between about thirty degrees and about sixty degrees.

15. The hand carried power tool as recited in claim 13, wherein said second acute angle is between about thirty degrees and about sixty degrees.

16. The hand carried power tool as recited in claim 1, wherein said resilient biasing member is a coil spring.

17. The hand carried power tool as recited in claim 16, wherein said coil spring has between about three coils and about twenty coils.

18. The hand carried power tool as recited in claim 1, wherein the interconnection between the power unit and the elongate handle comprises a female receiving portion, a male insertion portion and said vibration damping member in the form of an elastic collar surrounding the male insertion portion that prevents direct contact between the female receiving portion and the male insertion portion.

19. The hand carried power tool as recited in claim 18, wherein the male insertion portion is an end portion of the elongate handle.

* * * * *